US005797184A

United States Patent [19]

Tanaka et al.

[11] Patent Number: 5,797,184

[45] Date of Patent: Aug. 25, 1998

[54] METHOD OF MAKING A HEAT EXCHANGER

[75] Inventors: Hiroshi Tanaka, Isesaki; Kazuki Hosoya, Sawa-gun, both of Japan

[73] Assignee: Sanden Corporation, Gunma, Japan

[21] Appl. No.: 454,668

[22] Filed: May 31, 1995

Related U.S. Application Data

[63] Continuation of Ser. No. 361,301, Dec. 21, 1994, Pat. No. 5,586,598.

[30] Foreign Application Priority Data

Dec. 21, 1993 [JP] Japan ..... 5-346144

[51] Int. Cl.[6] ..... B23P 15/26

[52] U.S. Cl. ..... 29/890.053; 29/890.046; 165/133

[58] Field of Search ..... 29/890.049, 890.053, 29/890.045, 890.046; 165/133, 183, 170, 177

[56] References Cited

U.S. PATENT DOCUMENTS

| | | | |
|---|---|---|---|
| 2,136,641 | 11/1938 | Smith . | |
| 2,373,218 | 4/1945 | Arnold . | |
| 2,488,615 | 11/1949 | Arnold . | |
| 2,912,749 | 11/1959 | Bauernfeind et al. . | |
| 3,486,489 | 12/1969 | Huggins . | |
| 3,675,710 | 7/1972 | Rislow . | |
| 3,776,018 | 12/1973 | French | 72/367 |
| 4,044,797 | 8/1977 | Fujie et al. . | |
| 4,190,105 | 2/1980 | Dankowski . | |
| 4,201,263 | 5/1980 | Anderson . | |
| 4,570,700 | 2/1986 | Ohara et al. . | |
| 4,766,953 | 8/1988 | Grieb et al. . | |
| 5,351,397 | 10/1994 | Angeli | 29/890.053 |
| 5,372,188 | 12/1994 | Dudley et al. . | |
| 5,388,329 | 2/1995 | Randlett et al. | 29/890.049 |

FOREIGN PATENT DOCUMENTS

| | | | |
|---|---|---|---|
| 2058127 | 6/1992 | Canada | 29/890.049 |
| 0 237164 | 9/1987 | European Pat. Off. . | |
| 49 100638 | 9/1974 | Japan . | |
| 56 3752 | 1/1981 | Japan . | |
| 59 52196 | 3/1984 | Japan . | |
| 59 63494 | 4/1984 | Japan . | |
| 60 103298 | 6/1985 | Japan . | |
| 0108411 | 4/1990 | Japan | 29/890.049 |
| 221087 | 5/1942 | Switzerland . | |
| 2133525 | 7/1984 | United Kingdom . | |

*Primary Examiner*—Irene Cuda
*Attorney, Agent, or Firm*—Baker & Botts, L.L.P.

[57] ABSTRACT

A heat exchanger, such as a condenser, for use in a automobile air conditioning system includes a plurality of flat tubes for conducting the refrigerant and a plurality of corrugated outer fins fixedly sandwiched between the flat tubes. First and second header pipes are fixedly and hermetically connected to the flat tubes and, thereby, communicate with the interior of the tubes. A plurality of diagonally arranged projected stripes are formed on inner surfaces of the flat tubes. First portions of the projected stripes project from a lower inner surface of the flat tubes, and second portions of the projected stripes project from an upper inner surface of the flat tubes. The first and second portions of the projected stripes are in contact with one another at the points of intersection therebetween. Thereby, refrigerant flows through the flat tubes in a turbulent flow condition, so that the heat exchanging performance of the condenser increases while maintaining the internal pressure resistance strength of the tubes.

10 Claims, 7 Drawing Sheets

METHOD OF MAKING A HEAT EXCHANGER

This application is a continuation of application Ser. No. 08/361,301, filed Dec. 21, 1994 entitled "HEAT EXCHANGER", now U.S. Pat. No. 5,586,598.

BACKGROUND OF THE INVENTION

1. Field of the Invention

The present invention relates generally to a heat exchanger, and more particularly, to heat medium conducting elements which form a heat exchange region of a heat exchanger.

2. Description of the Prior Art

A heat exchanger, as illustrated in FIG. 1, is well known in the art, for example, U.S. Pat. No. 5,348,083. As shown in FIG. 1, a heat exchanger, such as condenser 100, includes a plurality of adjacent, substantially flat tubes 110 having oval cross-sections and open ends which allow refrigerant fluid to flow therethrough. A plurality of corrugated outer fin units 120 are fixedly disposed between adjacent flat tubes 110. Flat tubes 110 and fin units 120 form a heat exchange region 100*a*, at which an exchange of heat occurs. Cylindrical header pipes 130 and 140 having top and bottom open ends are disposed perpendicular to flat tubes 110. Partition plate 131 is disposed at an upper location within header pipe 130. An upper plug 132 is disposed in the top open end of header pipe 130, and a lower plug 133 is disposed in the bottom open end of header pipe 130. Partition wall 131, upper plug 132, and lower plug 133 divide header pipe 130 into upper fluid chamber 130*a* and lower fluid chamber 130*b*. Inlet pipe 150 extends into header pipe 130 and links upper fluid chamber 130*a* with other elements of the refrigerant circuit, e.g., a compressor (not shown). The two chambers 130*a* and 130*b* are isolated from each other.

Header pipe 140 includes a partition wall 141 disposed therein. Partition wall 141 is located within header pipe 140, but preferably below the location of partition wall 131 within header pipe 130. Upper plug 142 and lower plug 143 are disposed in the top open end and the bottom open end of header pipe 140, respectively. Partition wall 141, upper plug 142, and lower plug 143 divide header pipe 140 into upper fluid chamber 140*a* and lower fluid chamber 140*b*, each of which is isolated from the other. Outlet pipe 160 extends into header pipe 140 and links lower fluid chamber 140*b* with other elements of the refrigerant circuit, e.g., an accumulator (not shown). Flat tubes 110 having open ends are fixedly and hermetically connected to the inside of header pipes 130 and 140, so as to be in communication with the hollow interiors of header pipes 130 and 140.

In other prior art, such as Registered Japanese Design Patent No. 709839, a flat tube, substantially as illustrated in FIG. 2, is disclosed. Each of the flat tubes of condenser 100, which are illustrated in FIG. 1, may be replaced with the flat tube illustrated in FIG. 2.

Referring to FIG. 2, flat tube 210 includes flat tube member 211 and a plurality of projected stripes 212 integrally formed along an upper and a lower inner surface of flat tube member 211. Projected stripes 212 have substantially rectangular cross-sections and extend longitudinally along the inner surfaces of flat tube member 211. Projected stripes 212 are spaced from one another at about equal intervals. Thus, projected stripes 212 function as inner fins of flat tube 210. Flat tubes 210 further include a plurality of, e.g., three, partition walls 213. Partition walls 213 are integrally formed along the inner surfaces of flat tube members 211. Partition walls 213 extend longitudinally along flat tube members 211 and divide the interior of hollow portions of flat tube members 211, for example, into two rectangular parallel-piped hollow regions 214 and a pair of semicylindrical hollow portions 215 located at the lateral ends of each flat tube member 211. Hollow regions 214 and 215 extend parallel to one another. However, as discussed below, these hollow regions extend transversely relative to a flow direction "A" of the air, which flows across the exterior surfaces of the flat tube 210.

During operation of a refrigerant circuit including condenser 100 having a plurality of flat tubes 210, such as those illustrated in FIG. 2, the discharged refrigerant gas from a compressor is directed into upper fluid chamber 130*a* of header pipe 130 via inlet pipe 150. The refrigerant gas directed into upper fluid chamber 130*a* of header pipe 130 flows downwardly through upper fluid chamber 130*a* of header pipe 130. As the refrigerant gas flows downwardly through upper fluid chamber 130*a* of header pipe 130, it concurrently flows into hollow regions 214 and 215 of each of flat tubes 210 in the upper section of the heat exchange region 100*a* of condenser 100. Referring to FIG. 1, the gas then flows longitudinally from the left to the right side of condenser 100 through hollow regions 214 and 215 of each of the flat tubes 210 in the upper section of the heat exchange region 100*a*. The refrigerant gas in each of flat tubes 210 exchanges heat with air passing across corrugated fins 210 and liquefies. The flow direction of the air passing through condenser 100 is indicated by arrow "A" in FIG. 1. Accordingly, the air flows laterally across the exterior surface of flat tubes 210.

The refrigerant flows through hollow regions 214 and 215 of each of flat tubes 210 in the upper section of the heat exchange region 100*a* of condenser 100 and into upper fluid chamber 140*a*. This refrigerant flows downwardly through upper fluid chamber 140*a* of header pipe 140. Referring again to FIG. 1, the refrigerant then flows longitudinally from the right to the left side of condenser 100 through hollow regions 214 and 215 of each of the flat tubes 210 in a middle section of the heat exchange region 100*a*. Gaseous refrigerant remaining in each of flat tubes 210 exchanges heat with air passing across corrugated fins 120 and liquifies.

The refrigerant flowing through hollow regions 214 and 215 of each of flat tubes 210 in the middle section of the heat exchange region 100*a* of condenser 100 flows into lower fluid chamber 130*b* of header pipe 130 and downwardly through lower fluid chamber 130*b* of header pipe 130. Referring once again to FIG. 1, the refrigerant then flows longitudinally from the left to the right side of condenser 100 through hollow regions 214 and 215 of each of the flat tubes 210 in a lower section of the heat exchange region 100*a*. Again, gaseous refrigerant remaining in each of flat tubes 210 exchanges heat with air passing across corrugated fins 120 and liquefies.

The refrigerant flowing through hollow regions 214 and 215 of each of the flat tubes 210 in the lower section of the heat exchange region 100*a* of condenser 100 flows into lower fluid chamber 140*b* of header pipe 140. The refrigerant in lower fluid chamber 140*b* of header pipe 140 has been completely liquefied and is conducted to an accumulator (not shown) or other component of the refrigerant circuit via outlet pipe 160.

According to the prior art embodiment depicted in FIG. 2, the integral formation of partition walls 213 with flat tube member 211 prevents improper expansion of flat tube members 211 caused by the pressure of the refrigerant in flat tube 210. Thus, flat tube 210 may sufficiently resist the internal pressure forces of the refrigerant. Further, by forming projected stripes 212 and partition walls 213, the surface area with which the refrigerant comes in contact as it flows through flat tubes 210 increases, so that the heat exchanging performance of condenser 100 increases.

Nevertheless, during operation of the refrigerant circuit, the refrigerant in each of flat tubes 210 flows along projected stripes 212 and partition walls 213, so that the refrigerant flows through each of flat tubes 210 in a flow condition similar to a laminar flow condition. As a result, a thermal gradient occurs in the refrigerant which flows through flat tube 210. Referring to FIG. 2, due to this thermal gradient, the temperature of the refrigerant located at the leading portion of flat tube 210 becomes lower than that at the trailing portion of flat tube 210. Thus, the temperature of the refrigerant flowing through flat tube 210 is not uniform with respect to the lateral direction, i.e., the direction parallel to air flow direction "A", of flat tube 210. This thermal gradient in the refrigerant in flat tube 210 decreases the heat exchanging performance of condenser 100.

SUMMARY OF THE INVENTION

Therefore, it is an object of the present invention to provide a heat exchanger in which heat exchanging performance is improved while the heat exchanger maintains its resistance to internal refrigerant pressure.

According to the present invention, a heat exchanger comprises pipe means for directing a first fluid to flow therethrough, which includes at least one flat tube member across an exterior of which a second fluid laterally flows. Dispersing means disperse the flow of the first fluid, as the first fluid flows through the pipe means. The dispersing means includes a plurality of projected stripes formed on an inner surface of the at least one flat tube member. The plurality of projected stripes are arranged to diagonally extend along the at least one flat tube member. The projected stripes have first portions which project from a lower inner surface of the at least one flat tube member and second portions which project from an upper inner surface of the at least one flat tube. The first and second portions of the projected stripes intersect with one another, and the first and second portions of the projected stripes are in contact with one another at the intersections therebetween.

In another embodiment, the invention is a method of manufacturing a heat exchanger. The heat exchanger includes pipe means for directing a first fluid to flow therethrough. The pipe means include at least one flat tube member across an exterior of which a second fluid flows laterally. The heat exchanger also includes dispersing means for dispersing the flow of the first fluid, as the first fluid flows through the pipe means. The method comprises the steps of forming a plurality of projected stripes on an inner peripheral surface of a substantially circular tube member, having a longitudinal axis, such that the projected stripes extend along said circular tube member diagonally to the longitudinal axis; and pressing the circular tube member, so that the circular tube member forms a flat tube member with a lower inner surface from which first portions of the projected stripes project and an upper inner surface from which second portions of the projected stripes project. The first and second portions of the projected stripes intersect one another, and the first and second portions of the projected stripes contact one another at the intersections therebetween.

In still another embodiment, the invention is a method of manufacturing a heat exchanger. The heat exchanger includes pipe means for directing a first fluid to flow therethrough. The pipe means includes at least one flat tube member across an exterior of which a second fluid flows laterally. The heat exchanger also includes dispersing means for dispersing the flow of the first fluid when the first fluid flows through the pipe means. The method comprises the steps of forming a plurality of projected stripes on one surface of a plate member having a longitudinal axis, such that the projected stripes extend longitudinally along the plate member; forming a rectangular plate member having a longitudinal axis and two longitudinal edges from the plate member, such that the projecting stripes are diagonal to the longitudinal axis of the rectangular plate member; curling the rectangular plate member to form a cylindrical tube member with a longitudinal axis parallel to the longitudinal axis of the rectangular plate member; securing the edges of the rectangular plate member to each other so as to seal the cylindrical tube member; and pressing the cylindrical tube member, so that the cylindrical tube member forms a flat tube member with a lower inner surface from which first portions of the projected stripes project and an upper inner surface from which second portions of the projected stripes project. The first and second portions of the projected stripes intersect one another, and the first and second portions of the projected stripes contact one another at the intersections therebetween.

In yet another embodiment, the invention is a heat exchanger comprising pipe means for directing a first fluid to flow therethrough. The pipe means include at least one flat tube member across an exterior of which a second fluid flows laterally. The heat exchanger also includes dispersing means for dispersing the flow of the first fluid as the first fluid flows through the pipe means. The dispersing means include a mesh-like member disposed within each of the at least one flat tube member.

Other objects, features, and advantages of the invention will be apparent to persons skilled in the art in view of the following detailed description and the accompanying drawings.

BRIEF DESCRIPTIONS OF THE DRAWINGS

For a more complete understanding of the present invention and the objects, features, and advantages thereof, reference is made to the following description taken in conjunction with accompanying drawings in which.

Figure 3A:
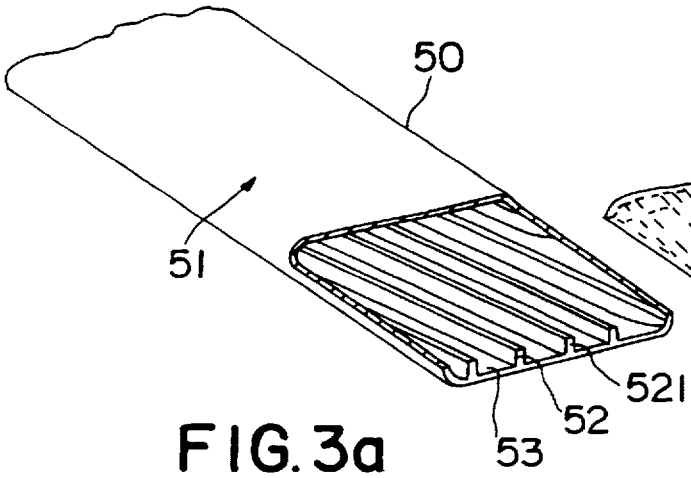
Figure 3B:
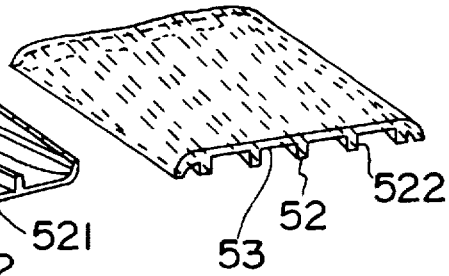

FIG. 3*a* is a partial perspective view of a flat tube used in a heat exchanger in accordance with a first embodiment of the present invention. FIG. 3*b* is an exploded view of a portion of the flat tube.

Figure 4:
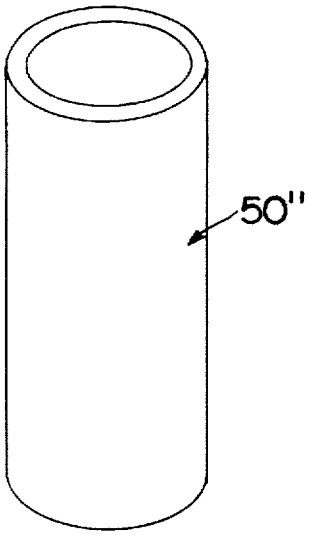
Figure 5:
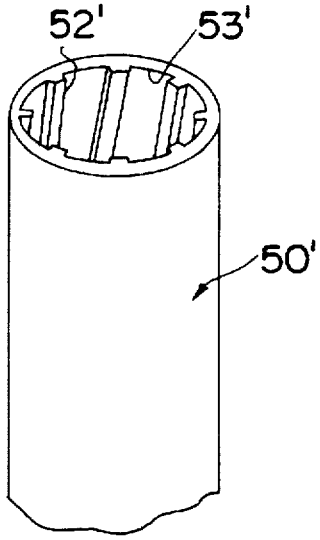

FIGS. 4–5 are views illustrating a manufacturing process for the flat tube shown in FIGS. 3*a* and 3*b*.

Figure 6:
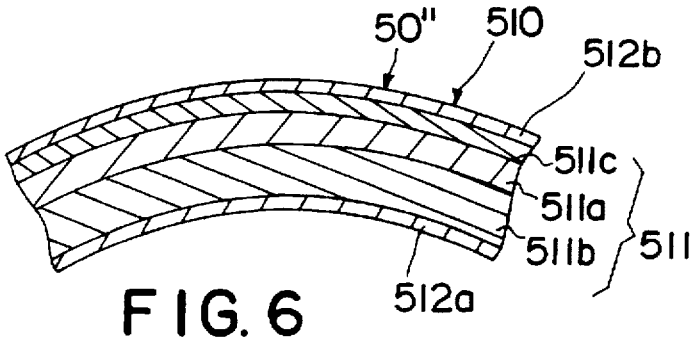

FIG. 6 is an enlarged partial cross-sectional view of an annular metal pipe member shown in FIG. 4.

Figure 7:
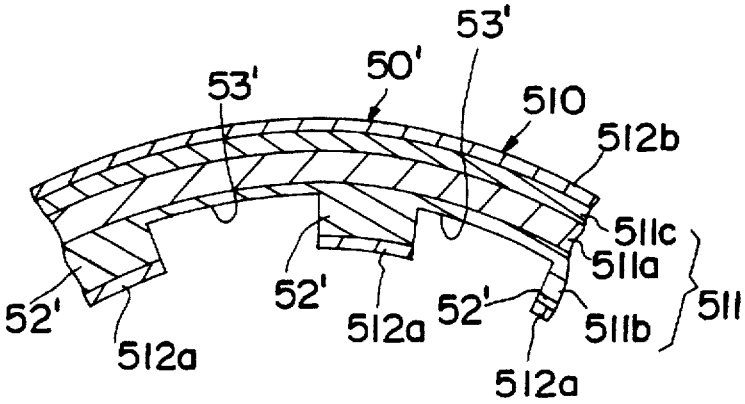

FIG. 7 is an enlarged partial cross-sectional view of an annular metal pipe member shown in FIG. 5.

Figure 8A:
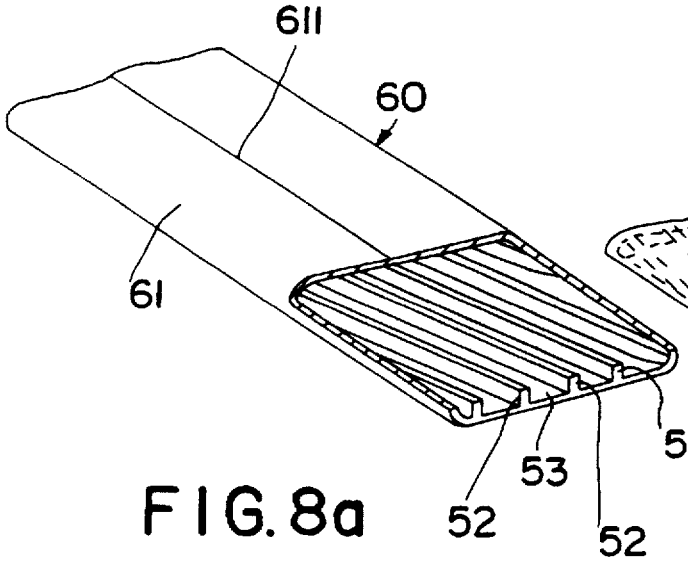
Figure 8B:
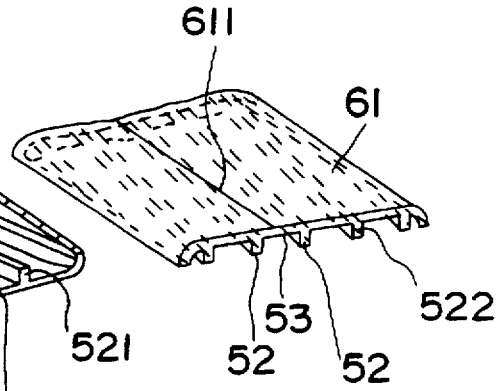

FIG. 8*a* is a partial perspective view of a flat tube used in a heat exchanger in accordance with a second embodiment of the present invention. FIG. 8*b* is an exploded view of a portion of the flat tube.

FIGS. 9–12 are views illustrating a manufacturing process for the flat tube shown in FIGS. 8*a* and 8*b*.

Figure 13:
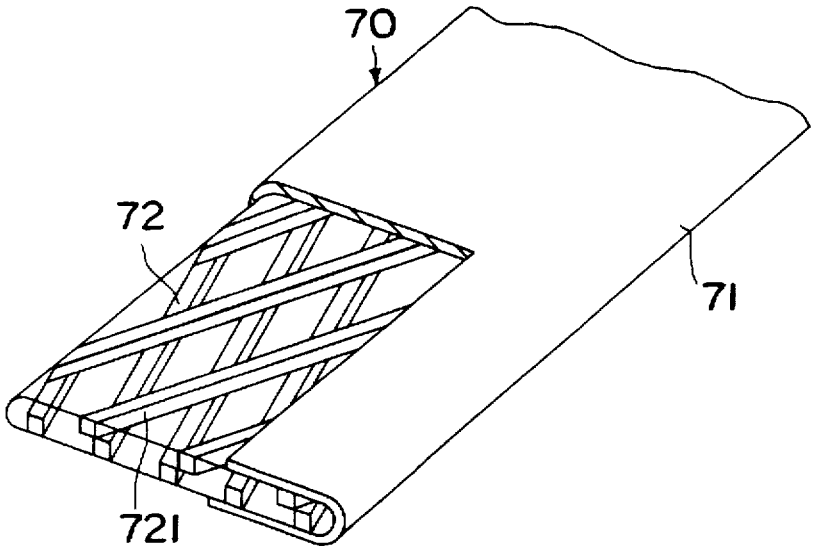

FIG. 13 is a partial perspective view of a flat tube used in a heat exchanger in accordance with a third embodiment of the present invention. A portion of the flat tube is cut away to reveal a mesh-like member disposed within an inner hollow space of a flat tube member.

DETAILED DESCRIPTION OF THE PREFERRED EMBODIMENTS

Figure 1:
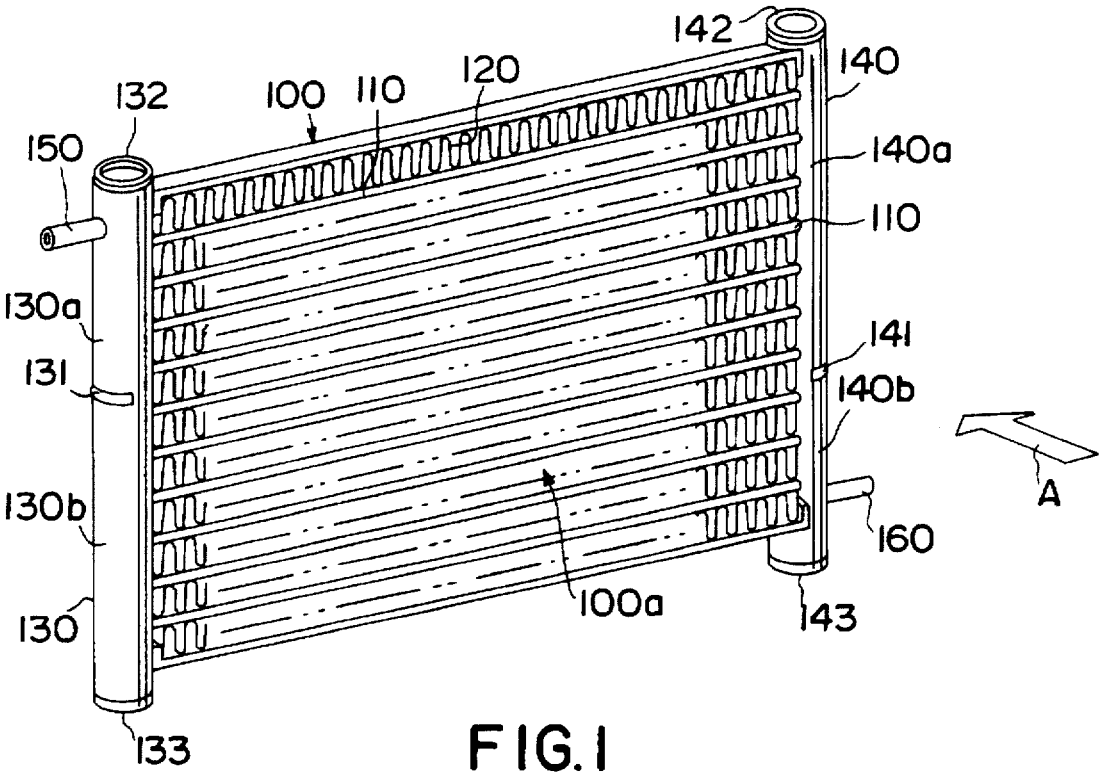
FIG. 1 PRIOR ART
FIG. 1 is a perspective view of a heat exchanger in accordance with a prior art embodiment.
Figure 2:
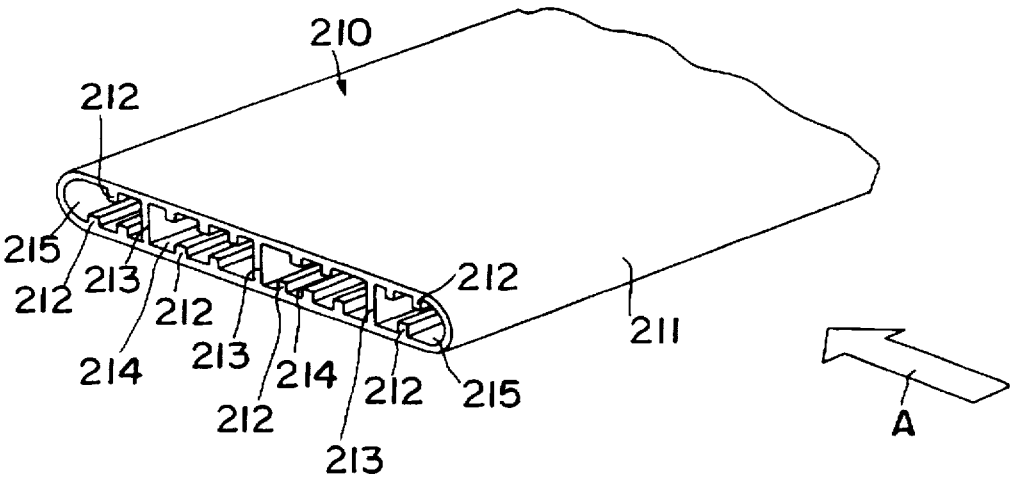
FIG. 2 PRIOR ART
FIG. 2 is a partial view in perspective of a flat tube used in a heat exchanger in accordance with another prior art embodiment.

The general structure of heat exchangers, such as a condenser, was described with respect to FIG. 1, so that further explanation thereof is omitted. Only features of the first embodiment of the present invention will be described in detail below with reference to FIGS. 3–7.

FIG. 3*a* illustrates a partial perspective view of a flat tube for use in a condenser in accordance with a first embodiment of the present invention. Referring to FIG. 3*a*, flat tube 50 includes flat tube member 51 and a plurality of identical projected stripes 52 integrally formed on an inner surface of flat tube member 51. Projected stripes 52 have substantially rectangular cross-sections and, as illustrated in FIG. 3*b*, extend helically along the length of flat tube member 51. Projected stripes 52 are spaced from one another at about equal intervals. Consequently, a plurality of identical helical grooves 53 having substantially rectangular cross-sections are formed between adjacent projected stripes 52. Projected stripes 52 function as inner fins of flat tube 50.

With reference to FIGS. 3–5, a method for manufacturing flat tube 50 is described in detail below. First, annular metal pipe member 50', as illustrated in FIG. 5, is formed from an annular metal pipe 50" having a longitudinal axis, as illustrated in FIG. 4, for example, by extruding. Referring to FIG. 5, annular metal pipe member 50' includes a plurality of identical projected stripes 52' formed on an inner peripheral surface thereof. Projected stripes 52' have substantially rectangular cross-sections and extend helically along the length of annular metal pipe member 50'. An angle of each of projected stripes 52' with respect to a plane which includes the longitudinal axis of annular metal pipe member 50' is designed to have a constant value selected from within a range of about 5 to 45 degrees. Preferably, the value is selected from within a range of about 5 to 30 degrees, and more preferably, it is selected from within a range of about 10 to 20 degrees. Projected stripes 52' are spaced from one another at about equal intervals. Consequently, a plurality of identical helical grooves 53' having substantially rectangular cross-sections are formed between adjacent projected stripes 52'.

As illustrated in FIG. 6, the annular metal pipe 50" may have a clad construction 510. Clad construction 510 is formed by an annular base metal member 511 and separate inner and outer annular brazing metal members 512*a* and 512*b*, which fixedly sandwich annular base metal member 511. The thicknesses of separate annular brazing metal members 512*a* and 512*b* are designed to be substantially equal. Annular base metal member 511 is formed by first, second, and third elements 511*a*, 511*b*, and 511*c*. First element 511*a* is fixedly sandwiched by second and third elements 511*b* and 511*c*. Second element 511*b* is located on an inner side of first element 511*a*, and third element 511*c* is located at an outer side of first element 511*a*. The thickness of second element 511*b* is designed to be greater than that of third element 511*c*. Annular brazing metal members 512*a* and 512*b* are made of selected brazing materials, for example, an aluminum alloy of AA4343. First, second, and third elements 511*a*, 511*b*, and 511*c* of annular base metal member 511 are made of certain materials. For example, first element 511*a* may be made of aluminum alloy of AA3003, and second and third elements 511*b* and 511*c* may be made of aluminum alloy of AA7072, which has a higher ionization degree than aluminum alloy of AA3003.

When annular metal pipe member 50' is formed from annular metal pipe 50" by extruding, portions of inner annular brazing metal member 512*a* and the structure of second element 511*b* of annular base metal member 511 are helically removed from annular metal pipe 50" to form projected stripes 52' and helical grooves 53' at about equal intervals, as illustrated in FIG. 7. As a result, inner annular brazing metal member 512*a* is removed and second element 511*b* of annular base metal member 511 is thinned at the positions corresponding to helical grooves 53' of annular metal pipe member 50'. However, inner annular brazing metal member 512*a* and second element 511*b* of annular base metal member 511 remain intact at the positions corresponding to projected stripes 52' of annular metal pipe member 50'.

After annular metal pipe member 50' has been formed, annular metal pipe member 50' is pressed, so that flat pipe 50, as illustrated in FIG. 3*a*, is formed. In constructing flat pipe 50, as illustrated in FIG. 3*a*, a first portion 521 of projected stripes 52 projects from a lower inner surface of flat pipe 50 and intersects with a second portion 522 of projected stripes 52 projecting from an upper inner surface of flat tube 50. Further, first and second portions 521 and 522 of projected stripes 52 contact with one another, so that a plurality of substantially rhombic contact portions (not shown) are defined therebetween. Accordingly, clad construction 510, as illustrated in FIG. 7, and particularly, inner annular brazing metal member 512*a* permit the substantially rhombic contact portions defined between the first and second portions 521 and 522 of projected stripes 52 to be brazed to one another during the process of brazing the condenser. As a result, lower and upper portions of flat pipe 50 are fixedly connected to each other through projected stripes 52, so that flat pipe 50 is reinforced to be able to sufficiently resist the force of internal refrigerant pressure.

In operation of a refrigerant circuit including a condenser according to the first embodiment, the refrigerant in each of flat tubes 50 flows along the first and second portions 521 and 522 of projected stripes 52, so that the refrigerant flows through each of flat tubes 50 in a turbulent flow condition. As a result, no thermal gradient occurs in the refrigerant which flows through flat tubes 50. Therefore, the temperature of the refrigerant flowing through flat tube 50 is substantially uniform with respect to the lateral direction of flat tube 50 and, thereby, the heat exchanging performance of condenser 100 increases.

FIG. 8*a* illustrates a partial perspective view of a flat tube 60 for use in a condenser in accordance with a second embodiment of the present invention. A construction of flat tube 60 is similar to that of flat tube 50 of FIGS. 3*a*–*b* except that a trace 611 is formed, for example, by electric resistance welding on an exterior surface of flat tube member 61 of flat tube 60.

Figure 9:
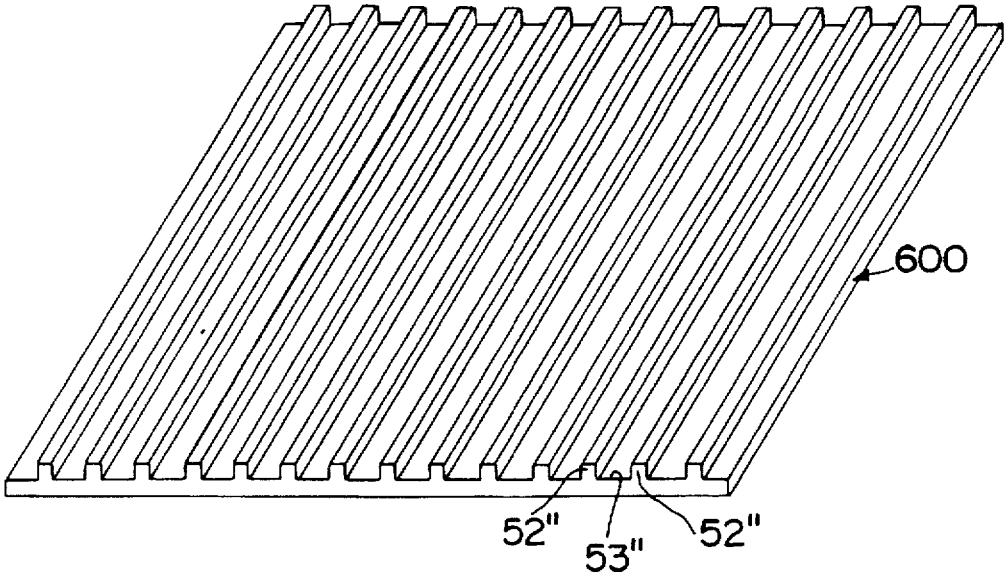

Referring to FIGS. 9–12, a method for manufacturing flat tube 60 is described in detail below. First, metal plate member 600, as illustrated in FIG. 9, is formed from a billet of aluminum alloy (not shown), for example, by extruding. Alternatively, metal plate member 600 may be formed by machining a metal plate (not shown). With reference to FIG. 9, metal plate member 600 includes a plurality of identical projected stripes 52" formed on one surface thereof. Projected stripes 52" have substantially rectangular cross-sections and extend longitudinally along metal plate member 600. Projected stripes 52" are spaced from one another at about equal intervals. Consequently, a plurality of identical grooves 53" having substantially rectangular cross-sections are formed between adjacent projected stripes 52". Further, metal plate member 600 may have a clad construction similar to the clad construction illustrated in FIG. 7.

Figure 10:
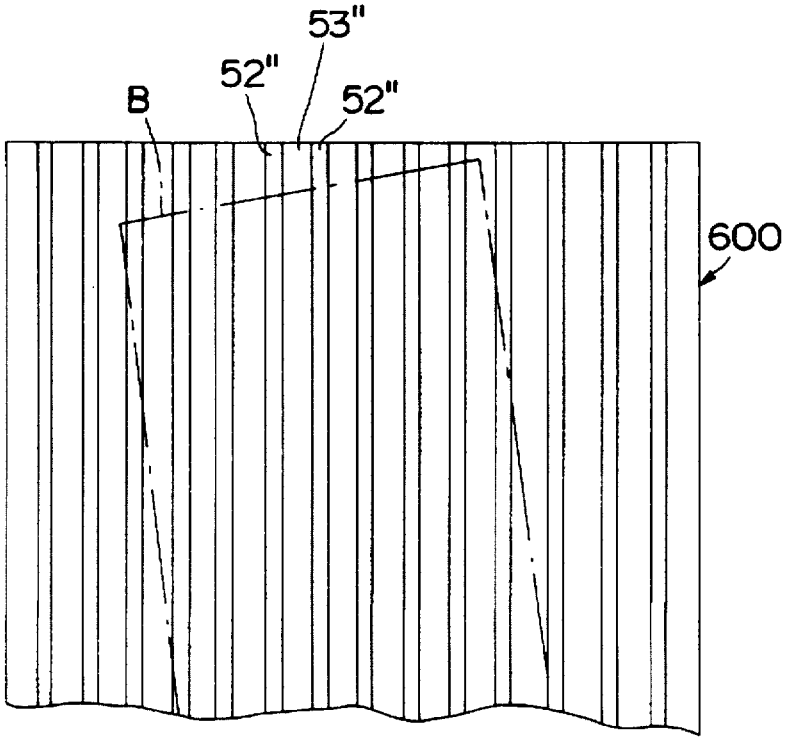
Figure 11:
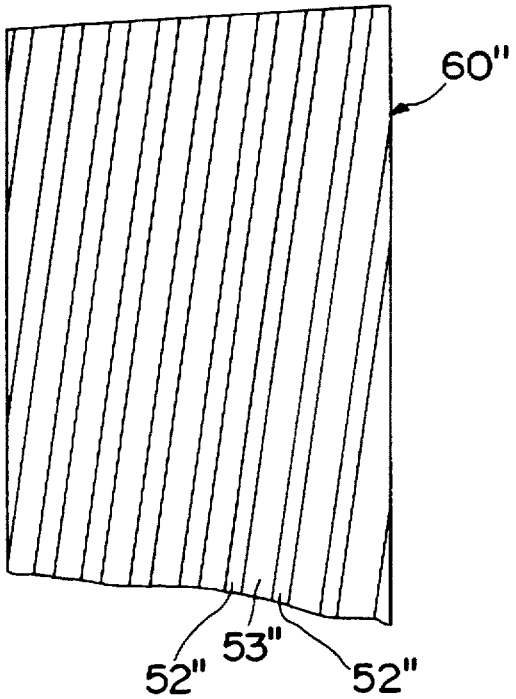

Rectangular metal plate member 60" illustrated in FIG. 11 then may be formed, for example, by punching metal plate member 600 along a dotted line labeled "B" in FIG. 10. Accordingly, projected stripes 52" are arranged to extend diagonally along the length of rectangular metal plate member 60", as illustrated in FIG. 11.

Figure 12:
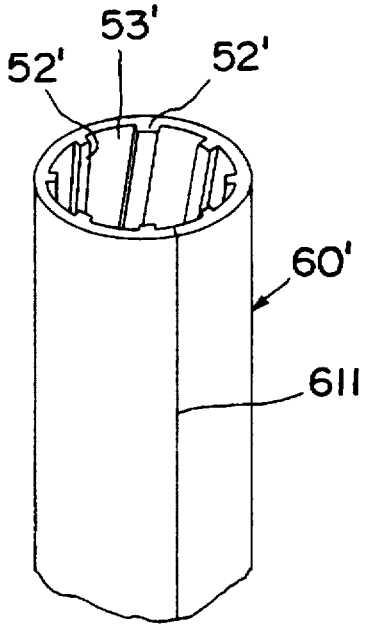

After it has been punched from metal plate member 600, rectangular metal plate member 60", having two longitudinal edges, may be curled by using a curling apparatus (not shown) to be cylindrical in shape, and then both edges of curled rectangular metal plate member 60" may be fixedly connected to each other, for example, by electric resistance welding. Thus, as illustrated in FIG. 12, annular metal pipe member 60' having projected stripes 52' and grooves 53' may be formed. In this step, the trace 611 of electric resistance welding is formed on an exterior surface of annular metal pipe member 60'.

Once annular metal pipe member 60' has been formed, annular metal pipe member 60' may be pressed, so that flat pipe 60, as illustrated in FIG. 8, is formed. Alternatively, flat pipe 60 illustrated in FIG. 8 may be formed directly from rectangular metal plate member 60" by curling plate member 60" into a more oval shape.

FIG. 13 illustrates a cutaway perspective view of a flat tube for use in a condenser in accordance with a third embodiment of the present invention. With reference the FIG. 13, flat tube 70 includes flat tube member 71 and a mesh-like member 72, which is disposed within a hollow space formed within flat tube member 71. The mesh-like member 72 is woven from a plurality of bars 721 of aluminum alloy. Bars 721 may have regular square cross-sections. In a process for manufacturing flat pipe 70, mesh-like member 72 may be loosely inserted into flat tube member 71, and then flat tube member 71 may be pressed, so that mesh-like member 72 is fixedly disposed within flat tube member 71. After pressing, flat tube member 71 and mesh-like member 72 are fixedly connected, for example, by brazing.

The objects, features, and advantages of the second and third embodiments are similar to those of the first embodiment, so that further explanation thereof is omitted.

The present invention has been described in detail in connection with preferred embodiments. These embodiments, however, are merely exemplary, and the invention is not restricted thereto. It will be understood by those skilled in the art that other variations and modifications may easily be made within the scope of this invention as defined by the following claims.

We claim:

1. A method of manufacturing a heat exchanger; said heat exchanger including pipe means for directing a first fluid to flow therethrough, said pipe means including at least one flat tube member across an exterior of which a second fluid flows laterally; and dispersing means for dispersing the flow of the first fluid, as the first fluid flows through said pipe means;

comprising the steps of:

forming a cylindrical tube member having a plurality of projected stripes on an inner surface thereof, said cylindrical tube member having a longitudinal axis, such that said projected stripes extend along said cylindrical tube member diagonally to said longitudinal axis; and pressing said cylindrical tube member, so that said cylindrical tube member forms a flat tube member with a lower inner surface from which first portions of said projected stripes project and an upper inner surface from which second portions of said projected stripes project, said first and second portions of the projected stripes intersecting one another, and said first and second portions of the projected stripes contacting one another at the intersections therebetween.

2. The method of claim 1, wherein an angle of each of the projected stripes with respect to a plane which includes the longitudinal axis of said cylindrical tube member is selected from within a range of about 5 to 45 degrees.

3. The method of claim 2, wherein said angle is selected from within a range of about 5 to 30 degrees.

4. The method of claim 2, wherein said angle is selected from within a range of about 10 to 20 degrees.

5. The method of claim 1, wherein said step of forming a cylindrical tube member comprises the steps of:

forming said plurality of projected stripes on one surface of a plate member having a longitudinal axis, such that said projected stripes extend longitudinally along said plate member;

forming a rectangular plate member having a longitudinal axis and two longitudinal edges from said plate member, such that said projecting stripes are diagonal to the longitudinal axis of said rectangular plate member;

curling said rectangular plate member to form said cylindrical tube member with a longitudinal axis parallel to said longitudinal axis of said rectangular plate member; and securing said edges of said rectangular plate member to each other so as to seal said cylindrical tube member.

6. The method of claim 5 wherein an angle of each of the projected stripes with respect to the longitudinal axis of said rectangular plate member is selected from within a range of about 5 to 45 degrees.

7. The method of claim 6, wherein said angle is selected from within a range of about 5 to 30 degrees.

8. The method of claim 6, wherein said angle is selected from within a range of about 10 to 20 degrees.

9. The method of claim 1, wherein the step of forming a cylindrical tube member comprises the step of forming a substantially circular tube member.

10. The method of claim 1, wherein the step of forming a cylindrical tube member comprises the steps of:

providing a cylindrical tube member having a longitudinal axis;

forming said plurality of projected stripes on an inner peripheral surface of said cylindrical tube member, such that said projected stripes extend along said cylindrical tube member diagonally to said longitudinal axis.

* * * * *